US007841996B2

(12) United States Patent
Sebelius et al.

(10) Patent No.: US 7,841,996 B2
(45) Date of Patent: Nov. 30, 2010

(54) POSITIONING DEVICE FOR USE IN APPARATUS FOR TREATING SUDDEN CARDIAC ARREST

(75) Inventors: Peter Sebelius, Lund (SE); Martina Rosell, Emmaboda (SE)

(73) Assignee: Jolife AB (SE)

( * ) Notice: Subject to any disclaimer, the term of this patent is extended or adjusted under 35 U.S.C. 154(b) by 967 days.

(21) Appl. No.: 10/579,862

(22) PCT Filed: Nov. 4, 2004

(86) PCT No.: PCT/SE2004/001596

§ 371 (c)(1),
(2), (4) Date: Feb. 7, 2007

(87) PCT Pub. No.: WO2005/046558

PCT Pub. Date: May 26, 2005

(65) Prior Publication Data

US 2007/0276298 A1 Nov. 29, 2007

(30) Foreign Application Priority Data

Nov. 17, 2003 (SE) ..... 0303054

(51) Int. Cl.
*A61H 31/00* (2006.01)

(52) U.S. Cl. ..... 601/41; 601/44

(58) Field of Classification Search ..... 601/41, 601/42, 43, 44, 97, 105, 106, 148, 149, 150, 601/151, 152
See application file for complete search history.

(56) References Cited

U.S. PATENT DOCUMENTS

| | | | | |
|---|---|---|---|---|
| 3,374,783 | A * | 3/1968 | Hurvitz | 601/41 |
| 3,509,899 | A | 5/1970 | Hewson | |
| 4,060,079 | A | 11/1977 | Reinhold, Jr. | |
| 4,915,095 | A | 4/1990 | Chun | |
| 5,399,148 | A * | 3/1995 | Waide et al. | 601/41 |
| 5,913,837 | A | 6/1999 | Smith | |

OTHER PUBLICATIONS

International Search Report PCT/SE2004/001596 dated Mar. 1, 2005.

* cited by examiner

*Primary Examiner*—Quang D Thanh
(74) *Attorney, Agent, or Firm*—Ostrolenk Faber LLP

(57) ABSTRACT

A positioning device for use in apparatus for treating sudden cardiac arrest in a patient in supine position by providing chest compressions at the lower end of the sternum prevents the apparatus from moving in a caudal direction. The apparatus includes a frame enclosing the patient at a sternal transversal plane and a pneumatic compression/decompression unit mounted on the frame. The device includes a flexible strap having a first end, a second end and a tensioning component disposed between the first and second ends. First and second end portions of the strap include a mechanism for attachment to the apparatus. The flexible strap has a mounted tensioned length sufficient to extend around the patient's neck. At least one of the end portions is releasably attached.

15 Claims, 5 Drawing Sheets

POSITIONING DEVICE FOR USE IN APPARATUS FOR TREATING SUDDEN CARDIAC ARREST

CROSS REFERENCE TO RELATED APPLICATION

The present application is a 35 U.S.C. §§371 national phase conversion of PCT/SE2004/001596, filed Nov. 4, 2004, which claims priority of Swedish Patent Application No. 0303054-1, filed Nov. 17, 2003. The PCT International Application was published in the English language.

FIELD OF THE INVENTION

The present invention relates to a positioning device for use in apparatus for treating sudden cardiac arrest.

BACKGROUND OF THE INVENTION

Sudden cardiac arrest is commonly treated mechanically and/or by electrical defibrillation. Mechanical treatment may be given manually or by a chest compression apparatus. The length of a compression/decompression cycle is typically from half a second to one second. A number of chest compression apparatus are known in the art, such as the pneumatically driven LUCAS™ mechanical chest compression/decompression system ("Lucas™ system"; an apparatus for compression and physiological decompression in Cardio-Pulmonary Resuscitation, CPR, manufactured by Jolife A B, Lund, Sweden). Specifically the Lucas™ system comprises a support structure and a compression/decompression unit. The support structure includes a back plate for positioning the patient's back posterior to the patient's heart and a front part for positioning around the patient's chest anterior to the heart. The front part has two legs, each having a first end pivotally connected to at least one hinge of the front part and a second end removably attachable to the back plate. The front part is devised to centrally receive the compression/decompression unit which is arranged to repeatedly compress/decompress the patient's chest when the front part is attached to the back plate. The compression/decompression unit comprises a pneumatic unit arranged to drive and control compression and decompression, an adjustable suspension unit to which a compression/decompression pad is attached, and a means for controlling the position of the pad in respect of the patient's chest. Defibrillation may be provided independently of and concomitantly with mechanical stimulation.

In cardiac arrest it is of utmost importance that adequate circulation be re-established as soon as possible, that is within a few minutes from the onset of arrest. Any delay might lead to irreversible tissue damage. By "adequate circulation" is understood a circulation which is sufficient to protect vital organs and tissues from (further) damage, in particular by damage caused by insufficient oxygen supply. Due to this requirement mechanical compression/decompression has to be started on the spot and most often continued during the transport of the patient to the hospital. It is thus important that the apparatus for mechanical compression/decompression can be moved with the patient while continuing with providing mechanical stimulation.

A problem with apparatus for treating cardiac arrest known in the art is that due to the vigorous pneumatic or other compression action and the anatomy of the human body, the apparatus has a tendency to move in respect to the patient in a caudal direction. This necessitates monitoring of the apparatus' position by the attending personnel in respect of the patient and to correct it, if needed. In a stressful situation like the one in which the apparatus for treating cardiac arrest is applied, this sort of monitoring may detract the attending personnel from other important duties. The present invention seeks to remedy this problem.

Another problem with apparatus for treating cardiac arrest known in the art is that moving them with a patient necessitates the assistance of three persons: Two to lift and carry the patient's body with the apparatus, one to the left and one to the right of the patient holding the apparatus with one hand and supporting the patient's seat with the other, and a third for holding the head to prevent it from falling back.

OBJECTS OF THE INVENTION

It is an object of the present invention to provide a positioning device for use in apparatus for treating sudden cardiac arrest which prevents the apparatus to move in a caudal direction in respect of the patient.

It is a another object of the invention to provide a positioning device for use in an apparatus for treating sudden cardiac arrest that supports the head of the patient so as to allow the patient to be moved with the apparatus by two persons rather than by three.

Other objects of the invention are to provide a means for positioning the patient's in a way so as to facilitate ventilation and intubation.

Further objects of the invention will be evident from the following summary of the invention, the description of preferred embodiments thereof illustrated in a drawing, and the appended claims.

SUMMARY OF THE INVENTION

According to the present invention is disclosed a positioning device for use in an apparatus for treating sudden cardiac arrest in a patient in supine position by providing chest compressions at the lower end of the sternum, which prevents the apparatus from moving in a caudal direction, the apparatus comprising a frame enclosing the patient at a sternal transversal plane and a pneumatic compression/decompression means mounted on the frame, the device comprising a flexible strap means having a first end, a second end and a tensioning means disposed between the first and second ends, first and second end portions extending from the first and second ends, respectively, comprising means for attachment to the apparatus at first and second positions thereof, respectively, the flexible strap means having a mounted tensioned length sufficient to extend around the patient's neck, with the proviso that at least one of the end portions is releasably attached.

It is preferred for the tensioning means to be integrated with the means for attaching the flexible strap means to the apparatus. It is also preferred for the positions of attachment to be arranged in an anterior frontal plane. The positions of attachment may coincide; in such case, they are preferably arranged in a sagittal plane.

The flexible strap means of the invention may be any of strap, belt, ribbon, band, wire and the like, here referred to as a strap, preferably of a woven material, in particular of a polymer material such as polypropylene, polyester or polyamide or a mixture of polymer materials.

According to a first preferred aspect of the invention both end portions of the flexible strap means are releasably attached.

According to a second preferred aspect of the invention the flexible means of the invention comprises a neck support. It is preferred for the neck support to be displaceable along the flexible means. Preferably the flexible means passes through a passage in the neck support. It is also preferred for the neck support to become locked in a selected position on the flexible strap means by the load of the patient's head exerted on the neck support due to the neck support being made in a compressible material. Thereby the passage through which the flexible strap means extends will be deformed and the flexible strap means will be squeezed between wall portions thereof. The neck support of the invention is designed for supporting the patient's neck and the occipital bone region. Thereby a proper position for (natural) ventilation is provided and intubation is facilitated. Intubation is often required in a situation where heart massage is given, for instance for adducing a breathing gas to the lungs of the patient which is more rich in oxygen than ambient air. The neck support may additionally be designed to prevent the patient's head from excessive turning to either side.

Apparatus for treating sudden cardiac arrest are of a type partially or wholly enclosing the patient at a lower sternal sagittal plane. Apparatus wholly enclosing the patient comprise a frame and a pneumatic compression/decompression unit mounted on the frame. The frame may typically comprise a back plate, left and right legs extending upwardly from the back plate and supporting a bridge element on which the pneumatic compression/decompression unit is mounted. Accordingly, the apparatus when applied to a patient can be considered to comprise two sides, a front side facing the head of the patient and a rear side facing the feet. The apparatus may erroneously be wrongly mounted to the patient, that is, with its mounting means for attachment of the flexible means facing the feet of the patient rather than the head. In a life-threatening condition the time available does not allow to dismount an apparatus once mounted. Therefore, according to a third preferred aspect of the invention, the flexible means is capable of being applied to the rear side as well as the front side and, preferably, to be easily displaceable from the front side to the rear side and vice-versa. Preferably the mounting means comprises a belt that can be disposed around a leg of the apparatus and a displacement member comprising a slot through which the belt passes. The displacement member comprises a means for coupling it with one end portion of the belt, such as a male or female member of a snap connection, the end portion of the belt being provided with the corresponding female or male member, respectively.

The invention will now be explained in more detail by reference to preferred embodiments illustrated by a rough drawing.

DESCRIPTION OF THE FIGURES

In the attached drawing.

DESCRIPTION OF PREFERRED EMBODIMENTS

Figure 1:
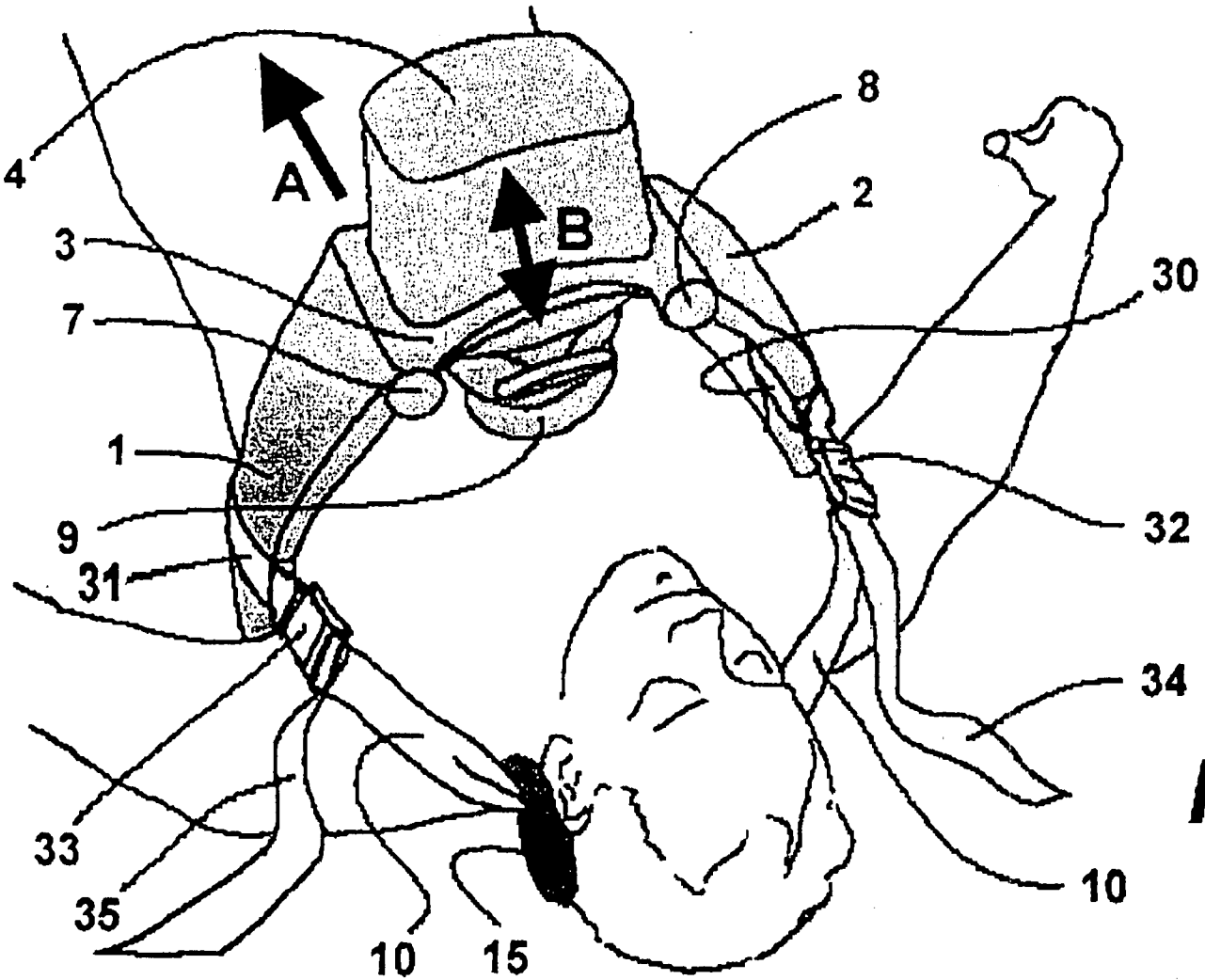
FIG. 1 is a perspective view of first embodiment of the device of the invention mounted at the legs of an apparatus for treating sudden cardiac arrest fully enclosing a patient to which mechanical heart compression/decompression is being provided, in a perspective view.
Figure 8:
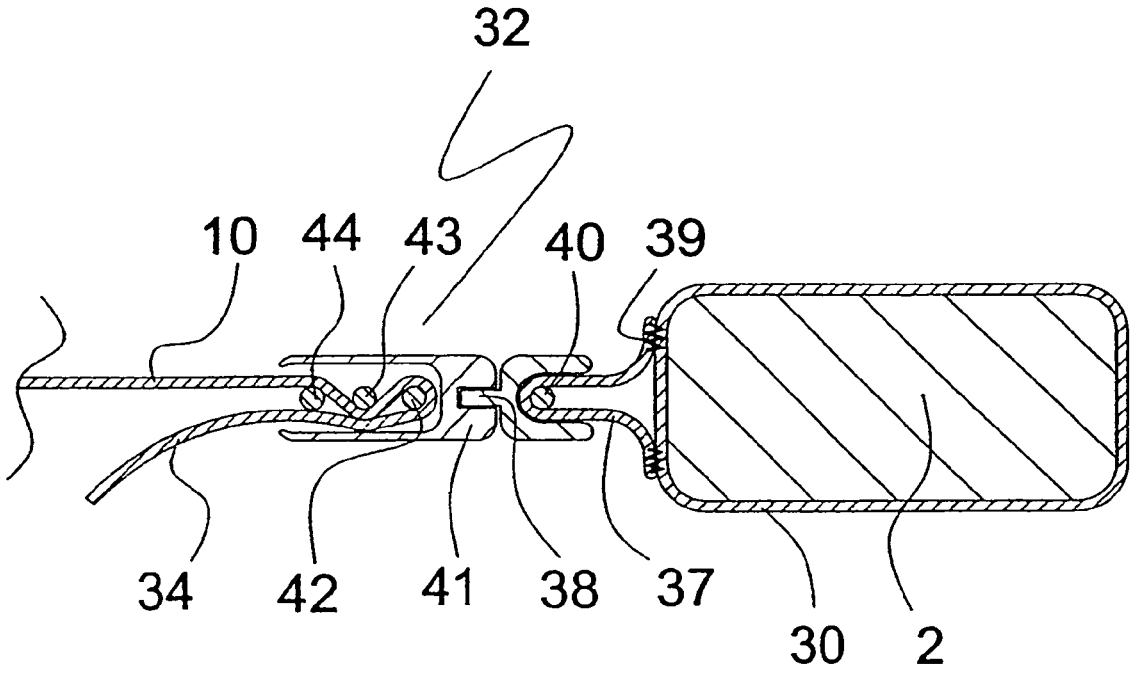
FIG. 8 is a sectional view of the mounting of the first embodiment shown in FIG. 1, with releasable connection means, tensioning means and an end portion of the flexible strap also being shown, in the same view as in FIG. 2.

FIG. 1 shows a patient in a supine position receiving heart massage by an apparatus for treating cardiac arrest. The apparatus for treating cardiac arrest is only shown to the extent required for illustrating the principles of the present invention. The apparatus, which shares the general design of the Lucas™ system, encloses the patient in the sternum region. The uppermost portion of the enclosure is positioned at a substantial distance above the patient's chest. "Left" and "right" designate positions from the patient's perspective. Curved left 1 and right 2 legs extend from a bottom plate (not shown) at which their first ends are releasably mounted. At their second ends the legs 1, 2 are swivelingly mounted via joints 7, 8, respectively, at a bridge element 3 that carries a central pneumatic compression/decompression unit 4. A plunger extends downwards from the compression/decompression unit 4 and terminates in a suction cup 6. By a reciprocating movement B of the plunger and the suction cup 6 the patient's breast is compressed and decompressed periodically. In its top or apical position the cup 6 abuts the uncompressed breast at the sternum, from which position the compression/decompression cycle starts. The apparatus for treating cardiac arrest allows the depth and rate of compression to be adjusted to suit the individual patient. Due to the anatomy of the chest the apparatus has a tendency to move in a caudal direction A. This movement is restricted by the positioning device of the invention which comprises a flexible but essentially non-elastic strap 10 having two end portions flanking a central strap portion which passes through a neck support 15. The strap is fixed via snap connections 32, 33 at mountings 30, 31 which, in turn are fixed to the left 1 and right legs 2, respectively. The snap connections 32, 33 comprise tensioning means and are shown in greater detail in FIG. 8. A belt 30 of synthetic textile material encloses tightly the right leg 2. At its short side it is connected by stitched seams 39 to the ends of a short piece 37 of same material so as to form an eye which holds a bar 40 of the male member 38 of a snap connection 32 of ordinary make. Its female member 41 comprises buckle means in form of three bars 42, 43, 44 defining two slots in which the flexible strap 10 is mounted and then is folded back. The strap can be tensioned by pulling the back-folded free end portion 34.

The device of the invention thus consists of a flexible strap provided with tensioning and, possibly, other means such as neck support means, two mountings releasably or non-releasably fixed to the legs of an apparatus for treating cardiac arrest, and releasable means for connecting left and right free end portions of the strap with the left and right mountings, respectively.

FIGS. 2 to 7 illustrate further preferred embodiments of the invention. The person skilled in the art will realize that the connecting, mounting, and tensioning means of the various embodiments are substantially exchangeable.

Figure 2:
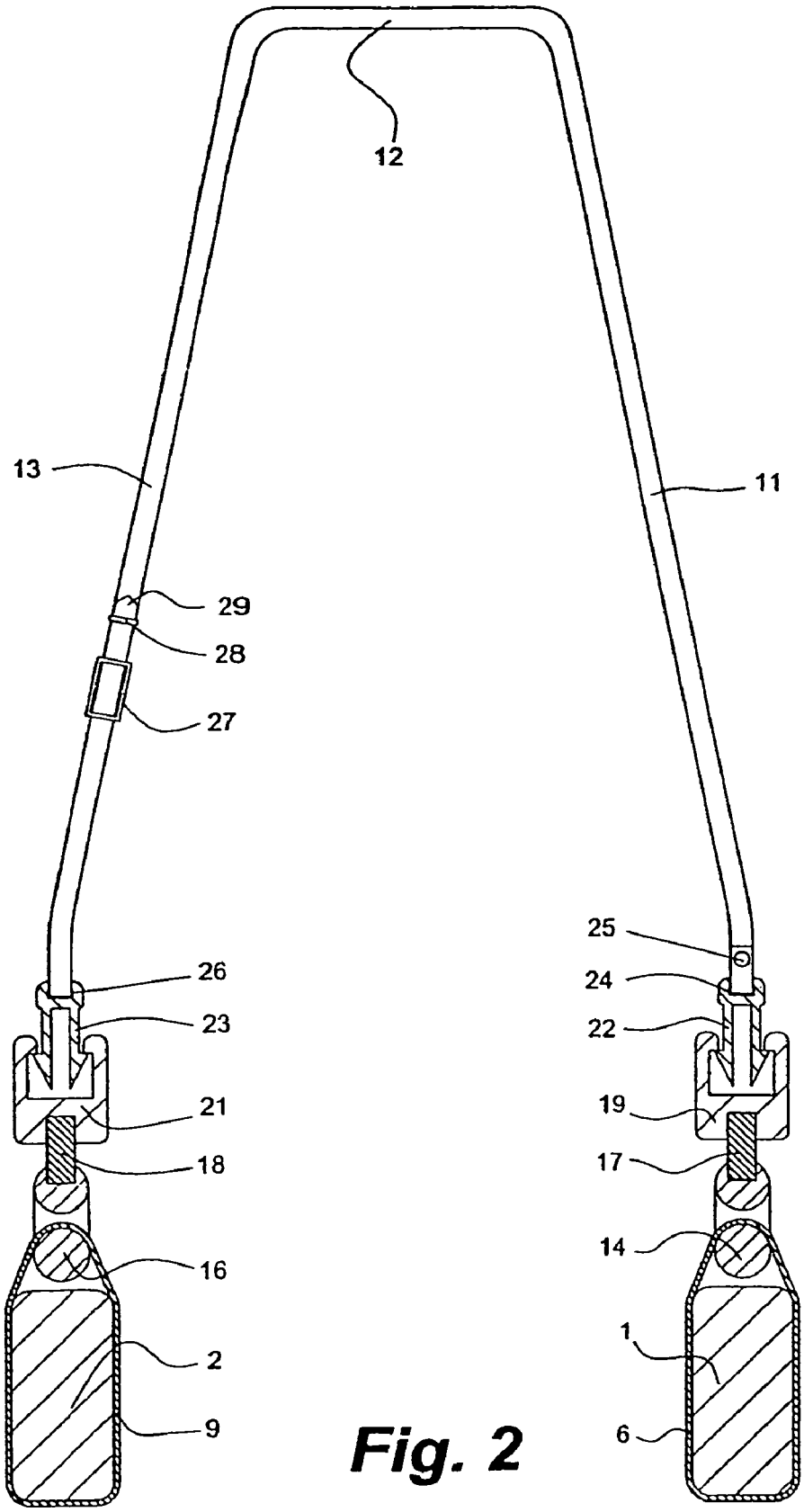
FIG. 2 is a second embodiment of the invention mounted at left and right legs of an apparatus of the aforementioned kind but with the patient omitted, the flexible means of the device disposed in a horizontal plane being shown in a top view but mounting being shown in a sectional view.

A second preferred embodiment of the invention is shown in FIG. 2, the strap of which comprises a left section 11, a right section 13, and a central section 12. At its left and right end portions the strap is connected to male 22, 23 members of separable connectors 22, 19; 23, 21, the male members of which are provided with eyes or slots 24 and 26, respectively. After passing through the slit 24 of the male member 23 the end portion of the left strap section 11 is folded back to abut a portion of the strap extending from the slit's 24 opposite side at which it is fixed by a rivet 25, thereby forming a loop. Similarly the right strap section 13 passes though slot 26. Its back-folded end portion, which is substantially longer than the back-folded end portion of the left strap section 11, is adjustably fixed to the portion of the right strap section 13 extending from the slit's 26 opposite side by a friction buckle 27 of ordinary make fastened at the strap section 13. A rectangular sleeve 28 holds the free end tongue 29 of the right strap section 13 in place. In FIG. 2 the male members 22, 23 of the left and right separable connectors are shown caught in corresponding female members 19, 21 by a snap mechanism. From the face of the female members 19, 21 facing away from the snap connection extend short flexible sheets 17, 18, the other ends of which are fixed at robust rings 14 and 16, respectively. The flexible sheets 17, 18 are rectangular sheets of a woven material which is embedded in the plastic material (polypropylene, polycarbonate or similar) of the male members 19, 21 and the rings 14, 16. The rings 14 and 16 are mounted at the left 1 and right 2 legs, respectively, of the apparatus by means of circular belts 6 and 9 which enclose the legs 1, 2 and pass through the openings of the rings 14 and 16, respectively. The size of the loop formed by a portion of the right strap section 13 can be adjusted (tensioned) by pulling the strap tongue 29. Thereby the total length of the strap 11, 12, 13 can be adjusted to fit a particular patient. A corresponding tensioning means can be arranged at the left strap portion 11 which then has to be given a length about corresponding to that of the right strap portion 13.

Figure 3:
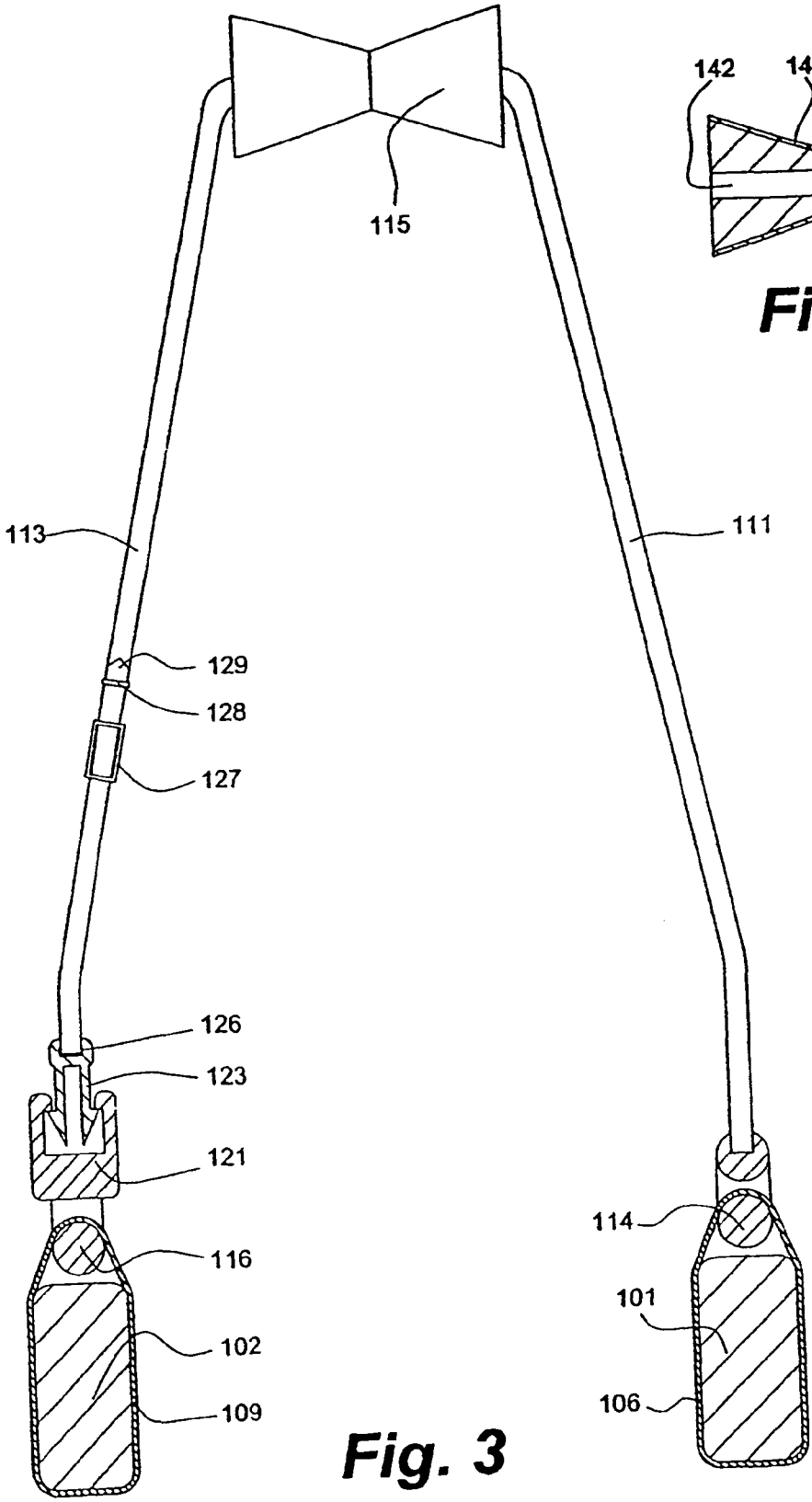
FIG. 3 is a third embodiment of the invention, in the same view as in FIG. 2.
Figure 4:
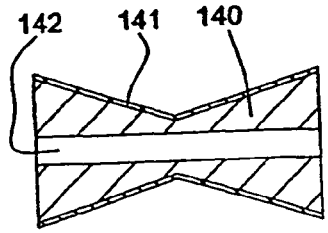
FIG. 4 is a longitudinal section through the neck support of FIG. 3.

In a third embodiment of the invention shown in FIG. 3 a section intermediate between the left 111 and right 113 sections of the strap passes trough a passage 142 in a neck support 115. The neck support 115 has the form of two truncated cones joined at their smaller bases. The neck support 115 is of a compressible polyurethane foam material 140 surrounded by a textile non-woven cover 141 (FIG. 4). When the neck and a portion of the patient's occipital bone region rest on the neck support 115 the polyurethane foam 140 and thus the passage 142 become compressed and squeeze the central portion of the strap, thereby hindering the support 115 from moving sideways. The second embodiment has only one releasable connector 121, 123. As in the first embodiment the male member 123 comprises a slot 126 through which part of the right strap portion 113 extends, as well as a friction buckle 127 and a rectangular sleeve 128 for holding the tongue 129 of the right strap section 113. The free end of the left strap portion 111 is embedded in a sturdy ring 114 fixed at the left leg 101 by means of a circular belt 106. The female member 121 of the separable connector 121, 123 is partially merged with a ring 116 (thus omitting the flexible sheet 18 of the first embodiment) for corresponding fixation at the right leg 102 by means of a circular belt 109. It is also possible to provide the left strap portion 111 with a tensioning means similar to the tensioning means 127 of the right strap portion 113, and to make the left strap section 111 correspondingly longer.

Fourth, fifth and sixth preferred embodiments of the invention described below differ from the aforementioned ones in regard of their mountings.

Figure 5:
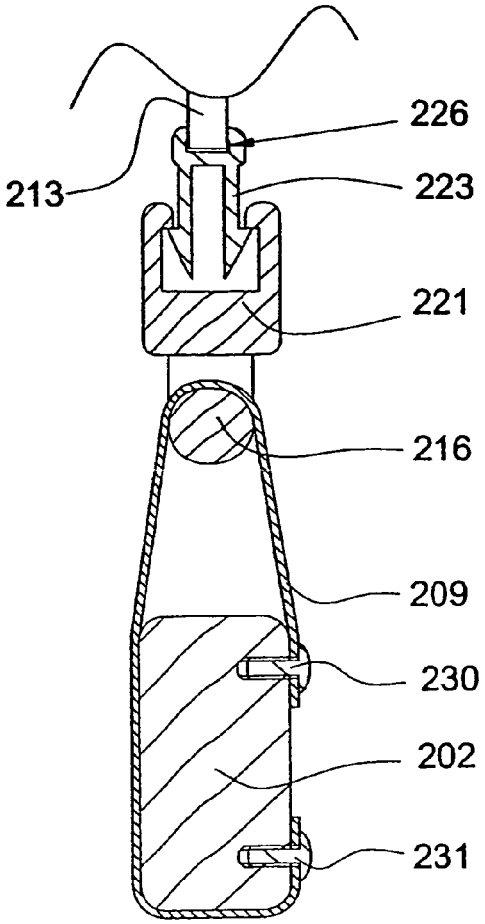
FIG. 5 is a sectional view of the mounting of a fourth embodiment of the invention, with releasable connection means and an end portion of the flexible strap also being shown, in the same view as in FIG. 2.

The mounting of the fourth preferred embodiment shown in FIG. 5 comprises a ribbon 209 of flexible material partly enclosing an about rectangular leg 202 to which it is fastened by screws 230 and 231 in bores arranged in one long side thereof. The length of the portion of the ribbon 209 extending between screws 230 and 231 is sufficient to allow the female snap member 221 to be moved from one short side of the leg 202 to its other short side.

Figure 6:
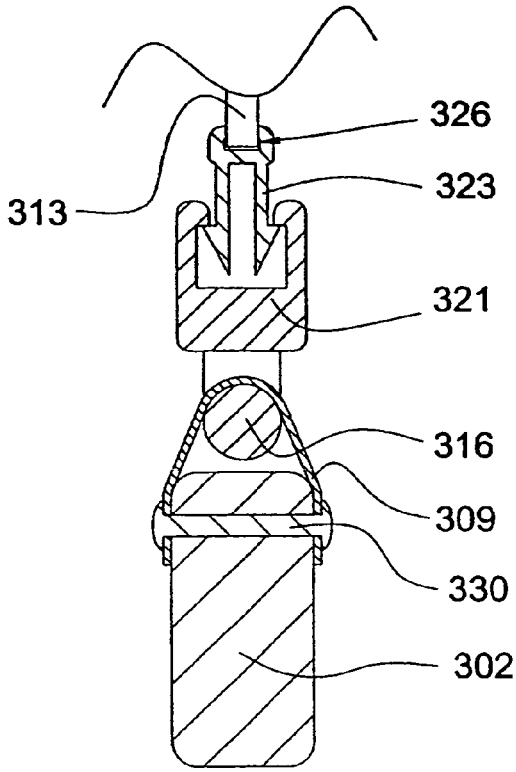
FIG. 6 is a sectional view of the mounting of a fifth embodiment of the invention, with releasable connection means and an end portion of the flexible strap also being shown, in the same view as in FIG. 2.

The mounting of the fifth preferred embodiment shown in FIG. 6 comprises a ribbon 309 of flexible material fastened at opposing long sides of a leg 302 close to one of its short sides by means of a twin-head stud 330 arranged in a through bore of leg 302 extending from one of its long sides to the other long side. The length of the ribbon 309 is just sufficient to let it pass through a hemi-circular eye 316 of the female member 321 of a snap connection 321, 323 of which are also shown the male member 323 carrying a slot 326 through which a right strap portion 313 according to the invention extends. This embodiment provides only for connection of the strap at one short side of the leg 302.

Figure 7:
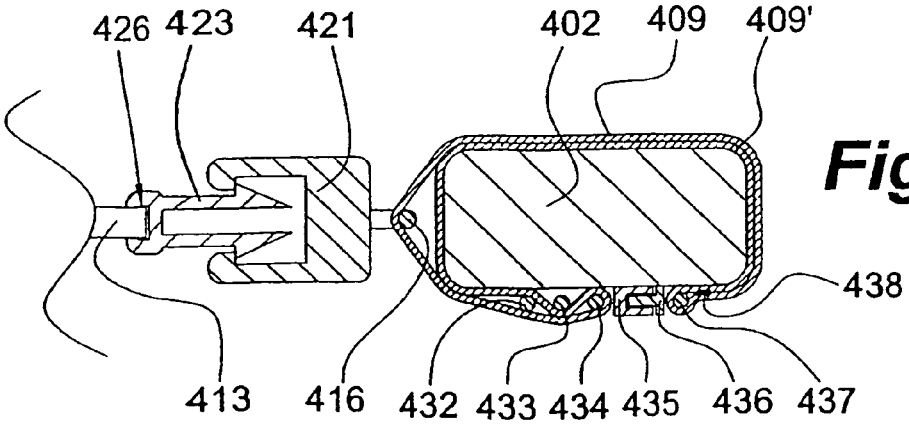
FIG. 7 is a sectional view of the mounting of a sixth embodiment of the invention, with releasable connection means and an end portion of the flexible strap also being shown, in the same view as in FIG. 2.

The mounting of the sixth preferred embodiment shown in FIG. 7 comprises a belt 409, 409' of a flexible material in a folded state to make its inner faces abut each other. The folded belt 409, 409' is mounted around a leg 402 so that its two loops nearly fully enclose the leg. The outer loop of the belt is designated 409 and the inner loop 409'. One fold of the belt 409, 409' encircle a pin 437 of a male member 436 of a snap connection 435, 436. Where the outer and inner loops 409, 409' meet after encircling the pint 437 they have fixed to each other by sewing 438. The other fold of the belt 109, 109' encircles the most distant (in relation to the belt 109, 109') pin 434 of a friction bucket 432, 433, 434 through which the inner loop 109' passes. The friction bucket 432, 433, 434 pertains to the female member 435 of said snap connection 435, 436. This arrangement allows the mounting to be mounted at a leg 402 with the inner loop 109' in a tensioned state and the outer loop 109 in a slackened state such that the bar 416 delimiting a slot of a female member 421 of a snap connection 421, 423 can be displaced along the outer loop 109 from one short side of the leg 402 to its other short side. The male member of snap connection 421, 423 is provided with a slot 426 through which a right strap portion 413 passes.

The device of the invention is preferably made from suitable polymer materials but also textile materials of natural origin and metal elements may be used for certain parts thereof. For instance, the bar 416 and the friction buckles 27; 127; 433, 434, 435 may, independent of each other, be made from a metal, in particular steel. Similarly, woven flexible straps, belts, and the like, such as strap 11, 12, 13, may be made of natural fibers, such as cotton, or of a blend of natural and synthetic fibers.

In rare circumstances a patient under treatment with an apparatus for treating sudden cardiac arrest of the aforementioned kind would also benefit from the apparatus being prevented from moving in an occipital direction. Such circumstances prevail during ambulance or similar transport of the patient with the apparatus. Normally patients are put in an ambulance on a stretcher head-on. The stretcher with the patient is fixed in position by a safety belt. In case of a collision or a rapid application of the brakes the apparatus seeks to move in an occipital direction. Thereby the centre of compression would be displaced in the same direction. The compressions then would be applied incorrectly and the patient risk to be injured as well as not properly treated. Such movement can be prevented by arranging one or several flexible straps fixed at the legs or other suitable part of the apparatus and extending from its rear side to the pubic arch, from there to the gluteal fascia and back to the legs of the apparatus. The flexible strap(s) for securing the apparatus in respect of the patient can be mounted to the leg(s) by means corresponding to those used in the device if the invention for preventing a movement in a caudal direction.

The invention claimed is:

1. A combination of an apparatus for treating sudden cardiac arrest in a patient in a supine position by providing chest compressions at the lower end of the sternum with a positioning device which prevents the apparatus from moving in a caudal direction, the combination comprising:

the apparatus including a frame enclosing the patient at a sternal transversal plane; and a pneumatic compression/decompression unit mounted on the frame; and the positioning device including a flexible strap having a first end, a second end and a tensioning component disposed between the first and second ends, the flexible strap further including first and second end portions extending from the first and second ends, respectively, the first and second end portions each including an attachment mechanism configured for attachment of the first and second end portions to the apparatus at first and second positions thereof, respectively, at least one of the end portions being releasably secured to the attachment mechanism, the flexible strap also having a mounted tensioned length sized to extend around the patient's neck.

2. The combination of claim 1, wherein the tensioning component is integrated with the attachment mechanism.

3. The combination of claim 1, wherein the positions of attachment are in an anterior frontal plane.

4. The combination of claim 1, wherein the flexible strap is selected from the group consisting of a strap, belt, ribbon, band and wire.

5. The combination of claim 4, where the flexible strap means is of a polymer material or a mixture of polymer materials.

6. The combination of claim 1, wherein the attachment mechanism comprises a snap connection.

7. The combination of claim 6, wherein the snap connection comprises two members, one member of the snap connection being mounted on the frame and the other member being mounted on one of the end portions of the flexible strap.

8. The combination of claim 7, wherein the frame comprises two legs disposed on either side of the patient, the one member of the snap connection being mounted on one of the legs.

9. The combination of claim 7, wherein the mounting of the one member of the snap connection on the frame is releaseable.

10. The combination of claim 8, wherein the mounting of the one member of the snap connection on the frame is configured to allow the one member to be displaced between a proximal and a distal face of the frame.

11. The combination of claim 1, wherein the positioning device further comprises a neck support.

12. The combination of claim 11, wherein the neck support is of a compressible material.

13. The combination of claim 11, wherein the neck support is slidably displaceable along the flexible strap.

14. The combination of claim 13, comprising wherein the positioning device further comprises a hindering mechanism operable to hinder displacement of the neck support in a loaded state thereof.

15. The combination of claim 7, wherein the tensioning component includes the member of the snap connection mounted on the end portion of the flexible strap.

* * * * *